US008371237B2

(12) United States Patent
Weber

(10) Patent No.: US 8,371,237 B2
(45) Date of Patent: Feb. 12, 2013

(54) COMPUTER WORK STATION WITH MOVEABLE MONITOR SUPPORT

(75) Inventor: Jeffrey A. Weber, Golden Valley, MN (US)

(73) Assignee: Herman Miller, Inc., Zeeland, MI (US)

( * ) Notice: Subject to any disclaimer, the term of this patent is extended or adjusted under 35 U.S.C. 154(b) by 437 days.

(21) Appl. No.: 12/509,943

(22) Filed: Jul. 27, 2009

(65) Prior Publication Data

US 2010/0024691 A1 Feb. 4, 2010

Related U.S. Application Data

(60) Provisional application No. 61/084,778, filed on Jul. 30, 2008.

(51) Int. Cl.
*A47B 57/00* (2006.01)

(52) U.S. Cl. ..... 108/97; 108/143; 108/102; 108/6

(58) Field of Classification Search ..... 108/9.77, 108/98, 90, 93, 50.01, 50.02, 143, 102, 6, 108/7, 97; 312/223.3; 248/118.3, 118.5, 248/292.12, 292.14, 298.1, 274.1, 918
See application file for complete search history.

(56) References Cited

U.S. PATENT DOCUMENTS

| | | | | | |
|---|---|---|---|---|---|
| 2,341,537 | A | * | 2/1944 | Froelich | 16/267 |
| 3,840,221 | A | | 10/1974 | Hogan | |
| 4,313,112 | A | | 1/1982 | Foster | |
| 4,365,561 | A | | 12/1982 | Tellier et al. | |
| 4,482,063 | A | | 11/1984 | Berke et al. | |
| 4,493,267 | A | | 1/1985 | Jedziniak | |
| 4,511,111 | A | * | 4/1985 | Godfrey et al. | 248/459 |
| 4,515,086 | A | | 5/1985 | Kwiecinski et al. | |
| 4,566,741 | A | | 1/1986 | Eriksson et al. | |
| 4,635,893 | A | * | 1/1987 | Nelson | 248/558 |
| 4,669,789 | A | | 6/1987 | Pemberton | |
| 4,706,920 | A | | 11/1987 | Ojima et al. | |
| 4,714,025 | A | | 12/1987 | Wallin et al. | |
| 4,717,112 | A | * | 1/1988 | Pirkle | 248/639 |
| 4,779,922 | A | | 10/1988 | Cooper | |
| 4,805,538 | A | | 2/1989 | Fisher et al. | |

(Continued)

FOREIGN PATENT DOCUMENTS

| | | |
|---|---|---|
| DE | 40 09 536 A1 | 9/1991 |
| DE | 42 00 965 | 7/1992 |

(Continued)

OTHER PUBLICATIONS

Office Action in U.S. Appl. No. 11/339,988 for Computer Workstation With Moveable Monitor Support, mailing date May 28, 2009, 8 pages.

(Continued)

*Primary Examiner* — Janet M Wilkens
*Assistant Examiner* — Daniel Rohrhoff
(74) *Attorney, Agent, or Firm* — Brinks Hofer Gilson & Lione

(57) ABSTRACT

A portable workstation configured for use with a primary worksurface includes a monitor support adapted to be moveably supported by the primary worksurface and an auxiliary worksurface pivotally connected to the monitor support about a horizontal axis. The auxiliary worksurface is automatically moveable with the monitor support and pivots downwardly from a first worksurface position to a second worksurface position. In one embodiment, a pivotable link member connects a base and a front portion of a worksurface. A method of configuring the workstation is also provided.

8 Claims, 15 Drawing Sheets

U.S. PATENT DOCUMENTS 4,828,342 A 5/1989 Stefan
4,880,270 A 11/1989 Cooper
4,890,561 A 1/1990 Hampshire et al.
4,915,450 A 4/1990 Cooper
4,981,085 A 1/1991 Watt
5,036,777 A * 8/1991 Barton ..... 108/90
5,044,284 A 9/1991 Gross
5,056,864 A 10/1991 Cooper
5,172,641 A 12/1992 Auer
5,183,230 A 2/1993 Walker et al.
5,199,773 A 4/1993 Price, Jr. et al.
5,240,210 A * 8/1993 Honto et al. ..... 248/118.1
5,263,668 A 11/1993 Reiter
5,287,815 A 2/1994 Gross
5,322,026 A 6/1994 Bay
5,339,750 A 8/1994 Smies
5,398,622 A 3/1995 Lubinskas et al.
5,408,940 A 4/1995 Winchell
5,419,525 A 5/1995 Hilton
5,424,912 A 6/1995 Mikan
5,437,235 A 8/1995 Randolph
5,443,017 A 8/1995 Wacker et al.
5,450,800 A 9/1995 Leonard
5,490,466 A 2/1996 Diffrient
5,522,323 A 6/1996 Richard
5,623,881 A 4/1997 Huang
5,671,091 A 9/1997 Monroe
5,680,820 A 10/1997 Randolph
5,712,761 A 1/1998 Dials et al.
5,765,910 A 6/1998 Larkin et al.
5,845,586 A 12/1998 Moore
5,857,415 A 1/1999 Richard
5,909,934 A 6/1999 McGraw
5,967,631 A 10/1999 Ko
5,992,810 A 11/1999 Crinion et al.
6,076,473 A 6/2000 Conte
6,092,868 A 7/2000 Wynn
6,119,605 A 9/2000 Agee
6,135,032 A 10/2000 Ko
6,269,753 B1 8/2001 Roddan
6,270,157 B1 8/2001 Kapushinski
6,296,408 B1 10/2001 Larkin et al.
6,315,358 B1 11/2001 Baru
6,374,752 B1 4/2002 Walser
6,382,745 B1 5/2002 Adkins
6,394,402 B2 5/2002 Coonan et al.
6,398,326 B1 6/2002 Wang
6,419,197 B2 * 7/2002 Kochanski et al. ..... 248/298.1
6,439,657 B1 8/2002 Tholkes
6,446,564 B1 * 9/2002 Anderson ..... 108/71
6,471,164 B2 * 10/2002 DiOrio ..... 248/118
6,474,760 B2 11/2002 Rauls
6,484,648 B1 11/2002 Long
6,536,356 B2 3/2003 Krieger et al.
6,568,650 B2 5/2003 Helmetsie et al.
6,615,428 B1 9/2003 Pattee
6,615,429 B2 9/2003 Weil et al.
6,691,626 B2 2/2004 Warner
6,736,469 B2 5/2004 Long
6,745,986 B1 * 6/2004 Bright ..... 248/346.01
6,799,816 B2 * 10/2004 Touzani ..... 312/208.1
6,802,264 B2 * 10/2004 Kasak et al. ..... 108/50.01
6,874,431 B1 4/2005 Danna
7,032,523 B2 4/2006 Forslund, III et al.
7,047,890 B2 5/2006 Korber et al.
7,127,962 B2 10/2006 Angeles et al.
7,322,653 B2 1/2008 Dragusin
7,461,822 B2 * 12/2008 Edwards ..... 248/214
7,690,317 B2 * 4/2010 Beck et al. ..... 108/143
7,721,658 B2 * 5/2010 Seeley et al. ..... 108/50.01
7,739,964 B2 * 6/2010 Hatton ..... 108/47
7,798,070 B2 * 9/2010 Ooba et al. ..... 108/7
8,051,782 B2 * 11/2011 Nethken et al. ..... 108/50.01
8,225,723 B2 * 7/2012 Nakamura et al. ..... 108/50.01
2002/0020329 A1 2/2002 Kowalski
2002/0056797 A1 5/2002 Solomon et al.
2004/0256524 A1 12/2004 Beck et al.
2004/0262485 A1 12/2004 Marceau et al.
2005/0285004 A1 12/2005 Elgie et al.
2006/0027146 A1 * 2/2006 Lee ..... 108/6
2006/0174807 A1 8/2006 Dral et al.
2008/0041279 A1 * 2/2008 Johnson ..... 108/35
2008/0072803 A1 * 3/2008 Korber et al. ..... 108/50.01
2010/0024691 A1 * 2/2010 Weber ..... 108/97
2011/0056412 A1 * 3/2011 Grammer et al. ..... 108/6
2011/0168062 A1 * 7/2011 Dellavecchia ..... 108/7

FOREIGN PATENT DOCUMENTS

EP 0 592 181 A2 4/1994

OTHER PUBLICATIONS

Notice of Allowance and Fees Due in U.S. Appl. No. 11/339,988, filed Jan. 25, 2006, mailed Jan. 8, 2010, 11 pages.
Notice of Allowance and Fees Due in U.S. Appl. No. 10/797,581, filed Mar. 10, 2004, mailed Jul. 30, 2009, 6 pages.
Official Communication (Office Action Summary) in U.S. Appl. No. 11/339,988, filed Jan. 25, 2006, mailed May 28, 2009, 8 pages.
Office Communication (Office Action Summary) in U.S. Appl. No. 10/797,581, filed Mar. 10, 2004, mailed Jan. 13, 2009, 12 pages.
Office Communication (Office Action Summary) in U.S. Appl. No. 10/797,581, filed Mar. 10, 2004, mailed Jun. 27, 2008, 2007, 10 pages.
Office Communication (Office Action Summary) in U.S. Appl. No. 10/797,581, filed Mar. 10, 2004, mailed Nov. 28, 2007, 8 pages.
Office Communication (Office Action Summary) in U.S. Appl. No. 10/797,581, filed Mar. 10, 2004, mailed Jun. 4, 2007, 8 pages.
Office Communication (Office Action Summary) in U.S. Appl. No. 10/797,581, filed Mar. 10, 2004, mailed Aug. 24, 2006, 6 pages.
Official Communication (Office Action Summary) in U.S. Appl. No. 10/797,581, filed Mar. 10, 2004, mailed Mar. 1, 2006, 8 pages.
Office Communication (Office Action Summary and Interview Summary) in U.S. Appl. No. 10/797,581, filed Mar. 10, 2004, mailed Aug. 29, 2005, 11 pages.
Australian Patent Application No. AU 2001100125 B9 entitled "Ergonomic device for use by a computer terminal user," published Aug. 2, 2001, for inventor Grant Richter, 21 pages.

* cited by examiner

COMPUTER WORK STATION WITH MOVEABLE MONITOR SUPPORT

This application claims the benefit of U.S. Provisional Application No. 61/084,778, filed Jul. 30, 2008, the entire disclosure of which is hereby incorporated herein by reference.

FIELD OF THE INVENTION

The present invention relates generally to a computer work station, and in particular, to a computer work station having a moveable monitor support.

BACKGROUND

Workstations can be configured with a monitor support that is moveably supported by a worksurface. In such workstations, the user can adjust the position of the monitor to accommodate their particular needs, for example when reclining in a chair. Other workstations are configured with a moveable worksurface. Again, the user can adjust the position of the worksurface to accommodate their particular needs. Some workstations can be configured with multiple support members that are moveable relative to each other. Typically, in such systems, the user must separately adjust each of the support members. In addition, the user may be required to actuate one or more locking or adjustment mechanisms for each component being moved once a desired location is achieved. In other configurations, two or more worksurfaces may be coupled together so as to automatically move with each other. Typically, however, such systems are configured with relatively complicated and expensive mechanisms, and are not portable or capable of being configured for use with, or on top of, a traditional worksurface such as a desk.

SUMMARY

The present invention is defined by the following claims, and nothing in this section should be considered to be a limitation on those claims.

In one aspect, one embodiment of a workstation includes a monitor support adapted to be move ably supported by a primary worksurface, wherein the monitor support is moveable between a first position and a second position. An auxiliary worksurface is pivotally connected to the monitor support about a horizontal axis, and is adapted to be moveably supported by the primary worksurface. The auxiliary worksurface is automatically moveable with the monitor support from a first worksurface position to a second worksurface position, with the auxiliary worksurface pivoting downwardly as the auxiliary worksurface is moved from the first worksurface position to the second worksurface position. In one embodiment, the auxiliary worksurface includes a bottom with a downwardly facing recess shaped to receive an edge portion of the primary worksurface as the auxiliary worksurface is moved from the first worksurface position to the second worksurface position and pivots about the horizontal axis.

In another aspect, one embodiment of the workstation includes a base member adapted to be supported on a primary worksurface. The base member includes a releasable attachment mechanism adapted to releasably secure the base member to the primary worksurface. A monitor support is moveably supported by the base member and is moveable between a first position and a second position. An auxiliary worksurface is pivotally connected to the monitor support about a horizontal axis and is moveably supported by the base member. The auxiliary worksurface is automatically moveable with the monitor support from a first worksurface position to a second worksurface position, with the auxiliary worksurface pivoting downwardly as the auxiliary worksurface is moved from said first worksurface position to said second worksurface position.

In another aspect, one embodiment of a workstation includes a base member adapted to be supported on a primary worksurface. The base member includes a releasable attachment mechanism adapted to releasably secure the base member to the primary worksurface. A worksurface includes a rear portion and a front portion, with the worksurface moveable between a first position and a second position. The front portion is automatically downwardly pivotable relative to the rear portion as the worksurface is moved between the first and second positions. At least one link member has a first end pivotally connected to the base about a pivot axis and a second end pivotally and translatably connected to the front portion.

In yet another aspect, a method for configuring a workspace includes providing a portable workstation having a base, a monitor support moveably coupled to the base and an auxiliary worksurface moveably coupled to the base, with the auxiliary worksurface being pivotable relative to the monitor support. The method further includes releasably securing the base to a primary worksurface, moving the monitor support from a first to second position, and automatically moving the auxiliary worksurface with the monitor support from a first worksurface position to a second worksurface position, and thereby pivoting the auxiliary worksurface downwardly about a horizontal axis.

The various embodiments of the workstation, and methods of configuring a workstation, provide significant advantages over other workstations. For example and without limitation, movement of either the monitor support or auxiliary worksurface causes the other thereof to move. In this way, the user can simply and easily adjust one of the monitor support or auxiliary worksurface, with the other following to a predetermined position so as to avoid multiple adjustments by the user. In addition, the auxiliary worksurface pivots as it moves toward the user, such that it moves with and is positioned for use by a user as they tilt rearwardly in a chair, for example.

In addition, the workstation is relatively portable, and is configured and adapted to be quickly and securely coupled to a primary worksurface, such as a desk or table. As such, a primary worksurface can be easily configured to provide the user with an ergonomic workstation, while allowing for the primary worksurface to be returned to its conventional state for other tasks.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction, and in general corresponds to a direction running between a front and back, for example from a front of a worksurface to a back thereof. The term "lateral," as used herein, means situated on, directed toward or running from side to side. The term "worksurface" as used herein means any surface capable of supporting an object, for example, a keyboard, mouse, document holder, papers etc., and includes for example and without limitation monitor supports, desk tops and/or keyboard trays/supports, and/or combinations thereof. The terms "coupled" and "joined" mean connected to or engaged with, whether directly or indirectly, for example with an intervening member or alternatively as integrally formed, and do not require the engagement to be fixed or permanent, although it may be fixed or permanent, and includes both mechanical and electrical connection. The term "pivot," "pivotable" and variations thereof refer to the turning movement of one member or portion thereof relative to another member or portion, whether about an actual or virtual axis, whether fixed or move able, and includes bending of a unitary member such that a portion of the unitary member is "pivoted" relative to another portion about the bend. It should be understood that the terms "first" and "second" positions, whether for the monitor support, auxiliary worksurface or worksurface, may variously correspond to a retracted, intermediate and extended position, but also correspond to various positions therebetween, with there simply being some movement or change in position between the first and second positions.

Referring to FIGS. 1, 20A-C, 21A-C and 28, a primary work surface 2 is shown. The primary worksurface is typically configured as a top of a desk, table or other type of worksurface. The primary worksurface 2 may be freestanding, meaning it is supported on a support surface, such as a floor, by a base, for example a frame, one or more legs, pedestals, etc., or combinations thereof. Other primary worksurfaces may be mounted to and extend from a vertical wall or wall panel, for example and without limitation by mounting to one or more of a wall panel frame, tile, connector or other wall panel component. Typically, the primary worksurface has an upper surface 4 oriented within a substantially horizontal plane, although it should be understood that the primary worksurface can be oriented at other suitable angles, or may be angularly, horizontally, and/or vertically adjustable.

Figure 12:
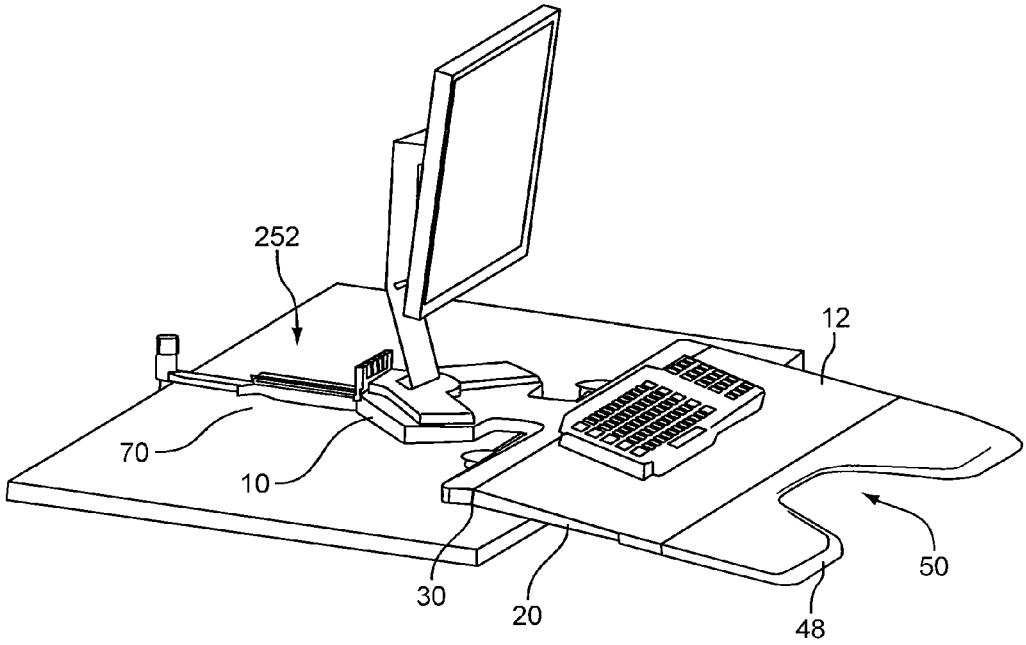
FIG. 12 is a perspective view of a third embodiment of a workstation releasably secured to a primary worksurface.
Figure 13:
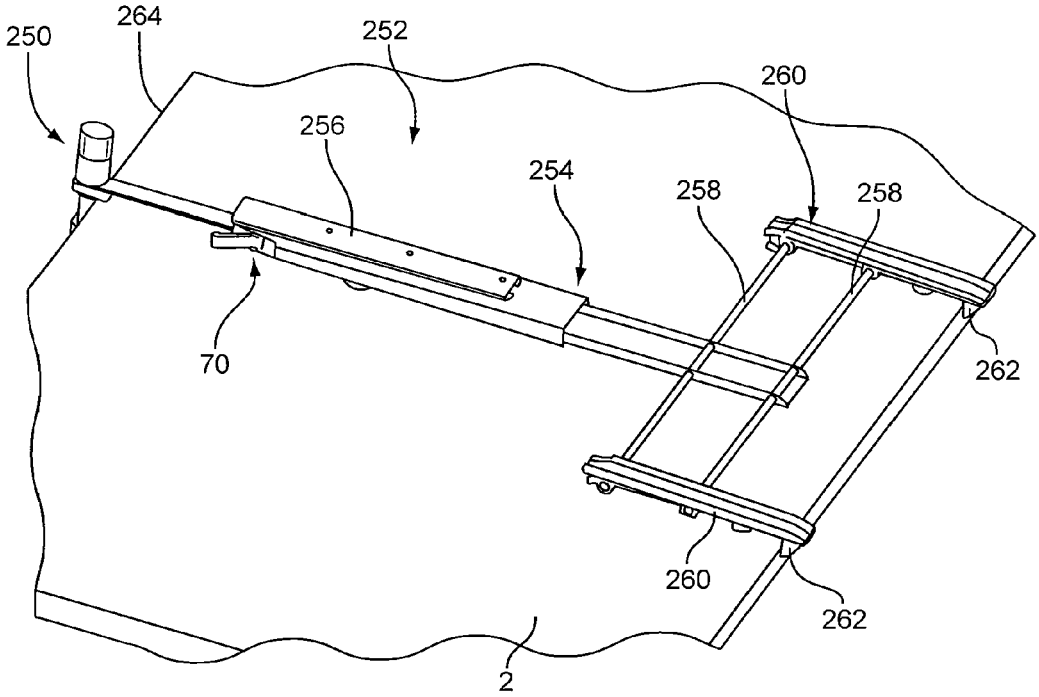
FIG. 13 is a perspective view of a base of the third embodiment of the workstation shown in FIG. 12 as secured to a primary worksurface.

Referring to FIGS. 1-8, a first embodiment of a workstation is shown. The workstation includes a monitor support 10 coupled to an auxiliary worksurface 12. It should be understood that the monitor support is any structure capable of supporting a monitor 6, defined as any viewing medium, such as a hard or soft screen, computer monitor, laptop computer, television or other type of know mediums, as shown for example in FIG. 4, by directly supporting such a monitor on a support surface 4 (without any latch or lock mechanism), or by being connected to the monitor through a monitor interface, such as an articulated monitor support arm, stand, etc. The monitor support can have any plan view shape, shown for example in FIGS. 12 and 14 as a lobe-shaped base shaped to support a V-shaped monitor base. In the embodiment of FIGS. 1-8, the monitor support 10 is configured as a substantially flat worksurface member having a front 14, rear 16 and opposite sides 24. In one embodiment, the total depth of the monitor support 10 and auxiliary worksurface 12 is less than 24 inches, or less than 36 inches in another embodiment. For example, in one embodiment, the monitor support is 12½ inches deep, while the auxiliary worksurface is 10½ inches deep (but may include an additional armrest or mousepad support having a depth of 7½ inches), for a total depth of 30½ inches. In one embodiment, the width of the system is equal to or less than about 40 inches, such that it fits on a standard 42 inch wide primary worksurface.

The rear 16 is configured in one embodiment with a vertical wall, or backsplash 28, while in other embodiments a backsplash is omitted. In one embodiment, the backsplash includes a grommet 26, having a plurality of resilient wire management receptacles. The backsplash also can be configured to hold or connect to lighting, storage, audio speakers, articulated monitor support arms, etc. It should be understood that the monitor support can be configured to secure or connect to articulated, or static, monitor supports in any number of ways suitable for a particular monitor configuration. In yet another embodiment, the monitor display is integrally formed as part of the monitor support.

The front 14 of the monitor support is connected to a hinge 30, configured in one embodiment as a piano hinge running substantially the entire width of the monitor support 20 in the lateral direction from side to side 24. The hinge also can be configured as a plurality of separate, discrete hinges spaced along the length of the front, or as one or more living hinges formed in part from the monitor support itself. In one embodiment, the monitor support 10 and auxiliary worksurface 12 are made of metal, such as aluminum or steel, although one or both can be made of wood, plastic, composites, or combinations of such materials. The monitor support, as well as the auxiliary worksurface, can include a core, such as particle board, with an overmolded cover material, such as urethane. The monitor support 10 is configured with opposite side walls 32 that define a downwardly opening recess 34 beneath the upper worksurface.

Figure 14:
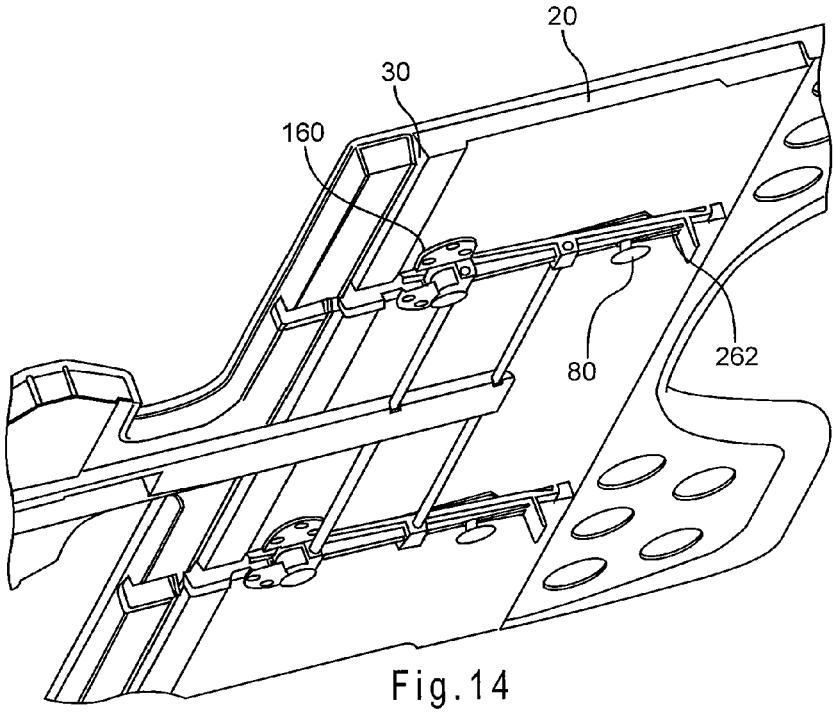
FIG. 14 is a bottom perspective view of the workstation shown in FIG. 12.
Figure 15:
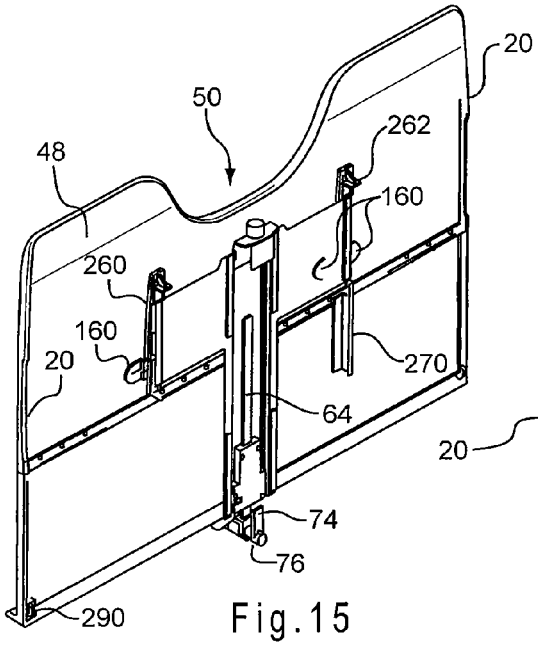
FIG. 15 is a bottom perspective view of a fourth embodiment of the workstation.
Figure 16:
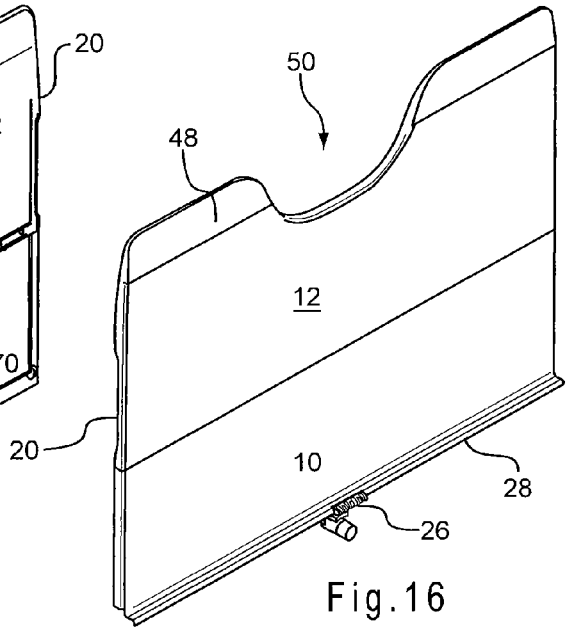
FIG. 16 is a top perspective view of the workstation shown in FIG. 15.

The auxiliary worksurface 12 as shown in FIGS. 1-7 is configured with a substantially flat or planar support surface and has a front 36, rear 38 and opposite sides 40. The rear 38 of the auxiliary worksurface is connected to the hinge 30, such that the auxiliary worksurface 12 is pivotally coupled to the monitor support 10 about a substantially horizontal axis 42. The auxiliary worksurface 12 also is configured with opposite side walls 44 that define a downwardly opening recess 46 beneath the worksurface. In one embodiment, the side walls have a concave bottom edge 20. The bottom edge 20 can be curved, or can be configured as a cut-out with straight edges, such as an upside down U-shape, as shown in FIG. 14. In other embodiments, the side walls can be omitted altogether, but with the understanding that the auxiliary worksurface is spaced above the primary worksurface, such that a space or recess, oriented beneath or downwardly from the auxiliary worksurface, is formed. In one embodiment, an upper surface 8 defined by the auxiliary worksurface is spaced no more than one (1) inch from the primary worksurface 2 when positioned thereover in a substantially parallel relationship, although it should be understood that it could be spaced a greater distance. In this way, the workstation does not appear to elevate the worksurface 12 too far above the primary worksurface 2.

An armrest 48 may be coupled to the front of the auxiliary worksurface and form part thereof. The armrest may be right or left handed, having a cutout 50 or recess positioned in the right or left hand side of the armrest, or the recess can be positioned in the middle of the armrest, with the recess providing space for the torso or body of the user. Of course, the front of the armrest may be configured in any linear, curvilinear or other shape to accommodate various users. The armrest may be made of any know resilient or padded materials, including a flex edge. The armrest may be covered with leather. The armrest may be fixedly or releasably connected to the auxiliary worksurface.

Figure 1:
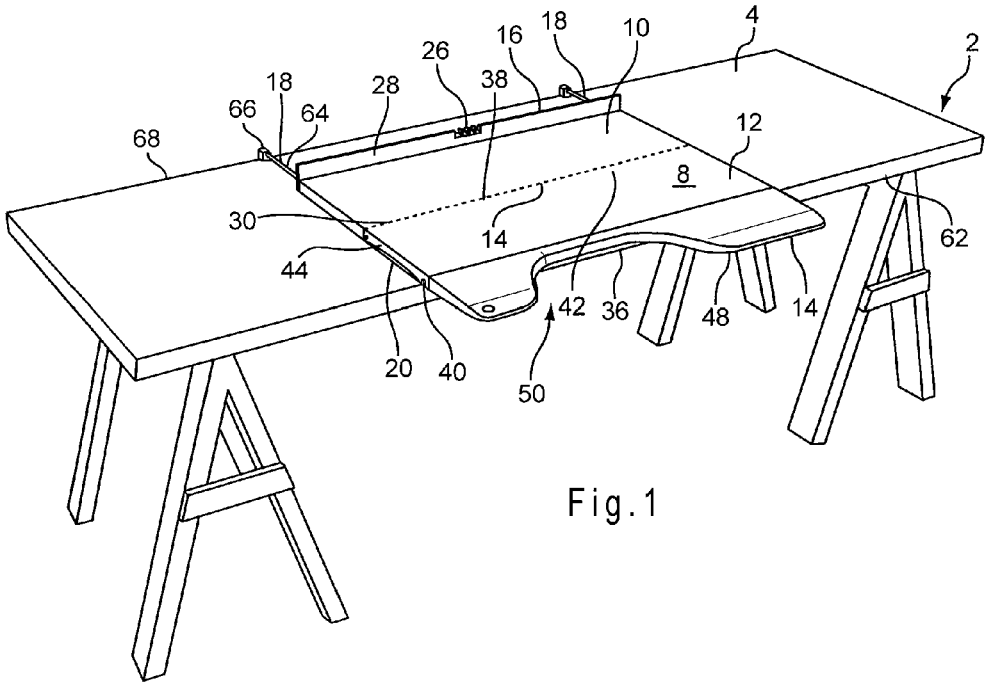
FIG. 1 is a perspective view of a workstation secured to a primary worksurface.
Figure 2:
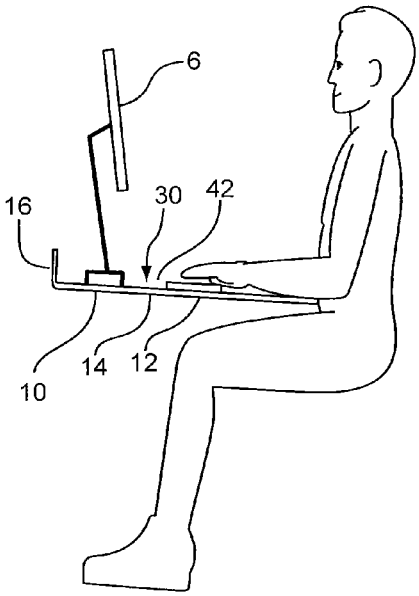
FIG. 2 is a side view schematic showing a user in an upright position using the workstation in a retracted position.
Figure 3:
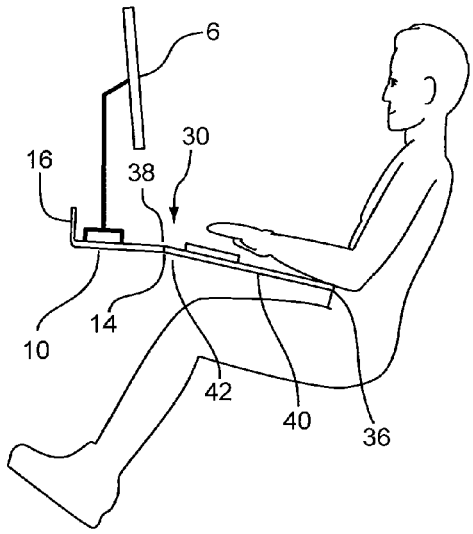
FIG. 3 is a side view schematic showing a user in a reclined position using the workstation in an extended position.
Figure 4:
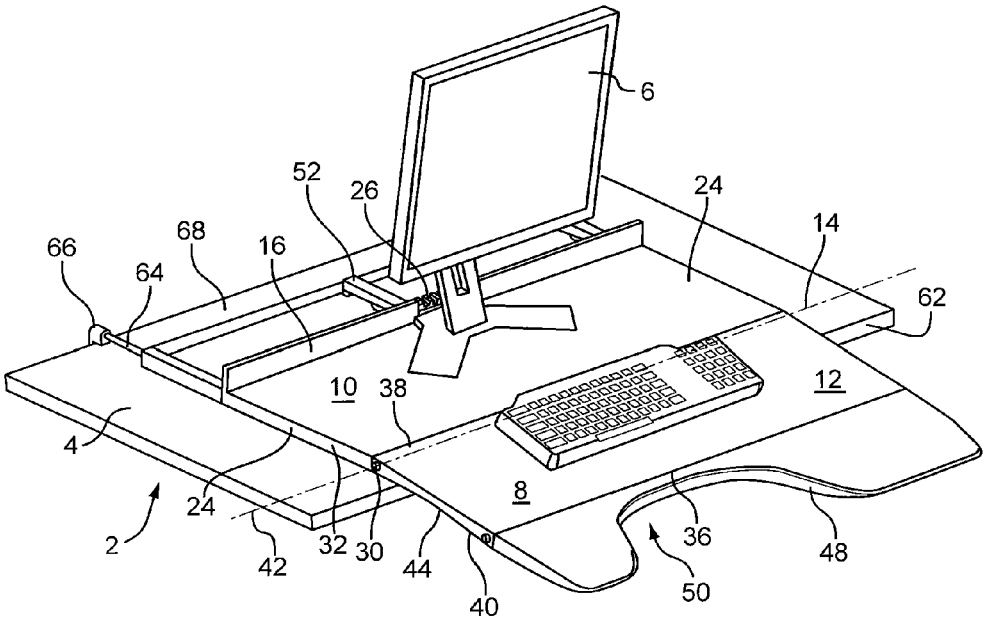
FIG. 4 is a front perspective view of the workstation shown in FIG. 1 with a monitor support and keyboard situated thereon in an extended position.
Figure 5:
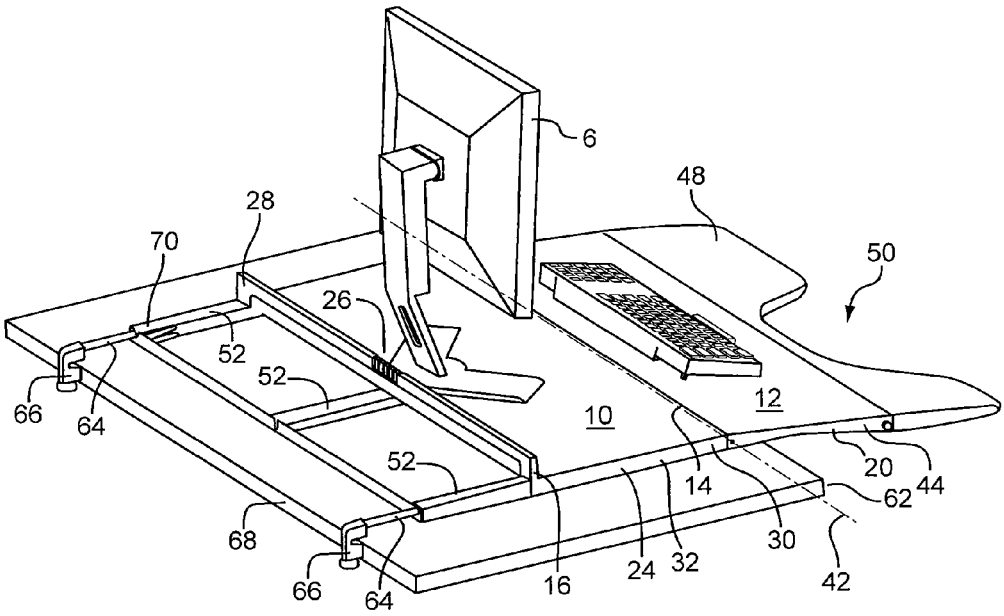
FIG. 5 is a rear perspective view of the workstation shown in FIG. 1 with a monitor support and keyboard situated thereon in an extended position.
Figure 6:
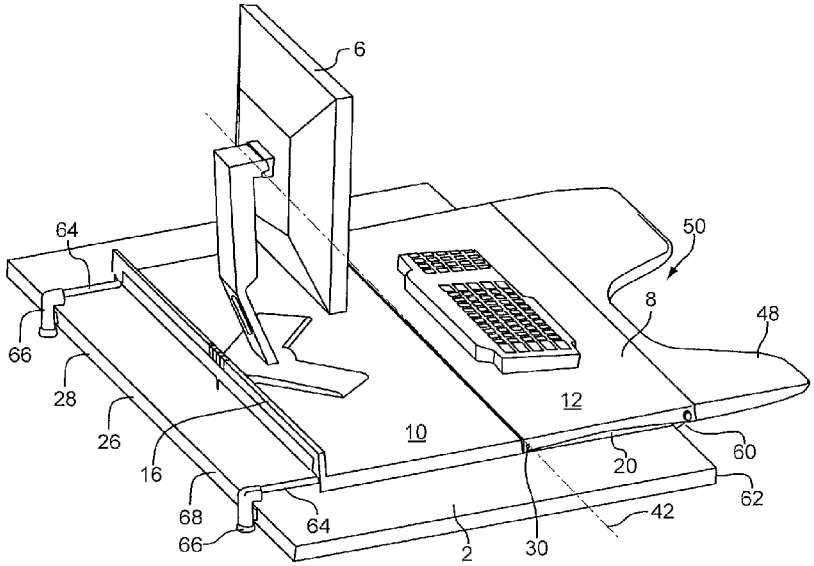
FIG. 6 is a rear perspective view of the workstation shown in FIG. 1 with a monitor support and keyboard situated thereon in a retracted position.
Figure 7:
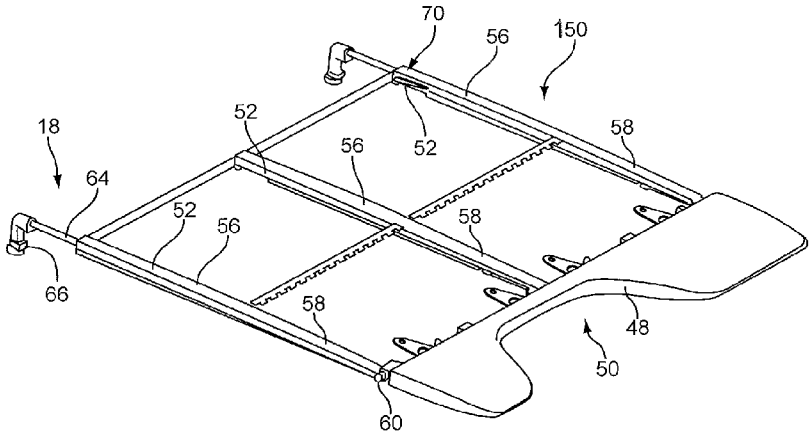
FIG. 7 is a top perspective view of a base, hinge and arm support.
Figure 8:
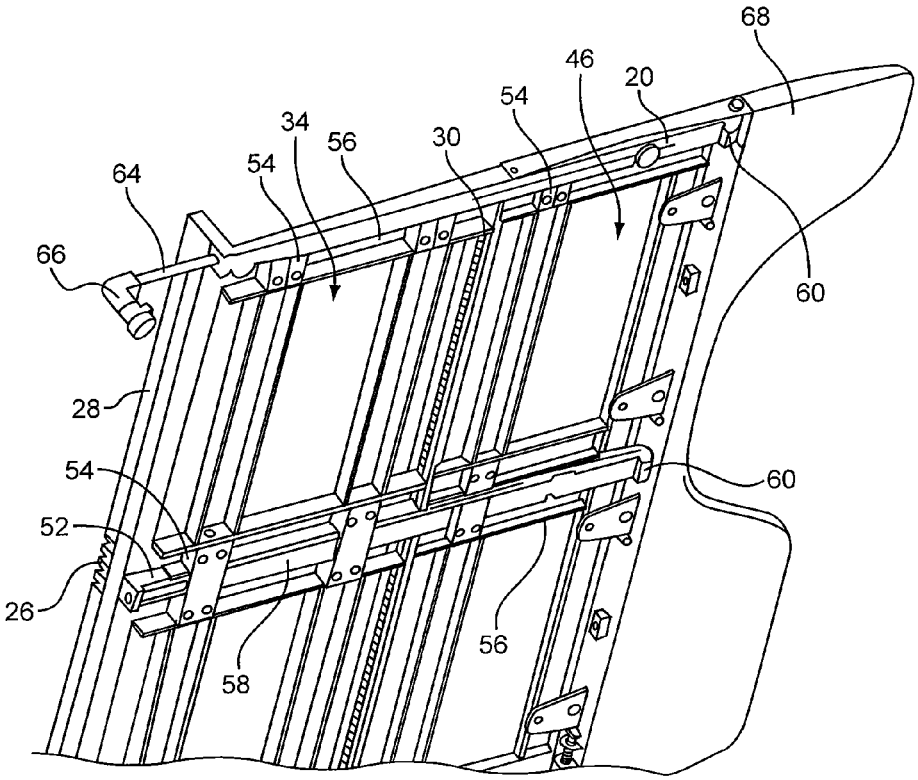
FIG. 8 is a bottom perspective view of the workstation shown in FIG. 1.

The monitor support 10 and auxiliary worksurface 12 are moveably supported by a base 150. As shown in FIGS. 7 and 8, the base includes a plurality of tracks 52 moveably engaging guide members 54 positioned on the monitor support and auxiliary worksurface. Of course, it should be understood that the tracks 52 and guide members 54 can be reversed, with the tracks positioned on the monitor support and auxiliary worksurface. The tracks each include a first and second portion 56, 58, otherwise referred to as first and second tracks. The first portion has a substantially horizontal trajectory or path, while the second portion has a downwardly sloping trajectory relative to a horizontal plane, or other plane parallel to and defined by the primary worksurface.

The front of the tracks 52 include downwardly extending stop or clamp members 60, which engage a front edge 62 of the primary worksurface 2. A pair of adjustable rear clamp members 18 extend rearwardly from the base. The rear clamp members include an adjustment shaft 64 that can be releasably extended relative to a corresponding track 52, with which it is slideably engaged. A rear stop or clamp member 66 extends downwardly and is shaped to engage a rear edge 68 of the primary worksurface. In operation, the front stop member 60 is engaged with the front edge 62 of the primary worksurface and the rear stop member 66 is then brought forward into a firm, clamping engagement with the rear edge 68 such that the workstation is releasably, fixedly secured or mounted to the primary worksuface 2. A lever or other release component 70, is accessible and can be actuated so as to permit the extension of the adjustment shafts. When released, a clamp or cam device engages the shaft to prevent further displacement. It should be understood that any type of conventional lock device, whether having infinite, frictional adjustment, or discrete detents, can be used to secure the extension member.

One or both of the front and rear clamp members 60, 66 can be configured with a lip that is positioned and shaped to engage a bottom of the primary worksurface so as to prevent vertical movement of the workstation relative to the primary worksurface. In other embodiments, the clamping force produces sufficient friction to prevent such vertical movement and the lip portions can be omitted. In yet another embodiment, shown in FIGS. 9-11, the rear and/or front clamps are configured with an upper clamp surface 72 and a lower clamping member 74. An adjustment mechanism 76, such as a lead screw having a grippable member, is connected between the upper and lower clamp members so that they can be moved toward and away from each other to accommodate and be clamped to primary worksurfaces having different thicknesses. A quick release mechanism 70 is provided to allow clamp bar 64 to be extended or retracted to accommodate different length primary worksurfaces.

Figure 9:
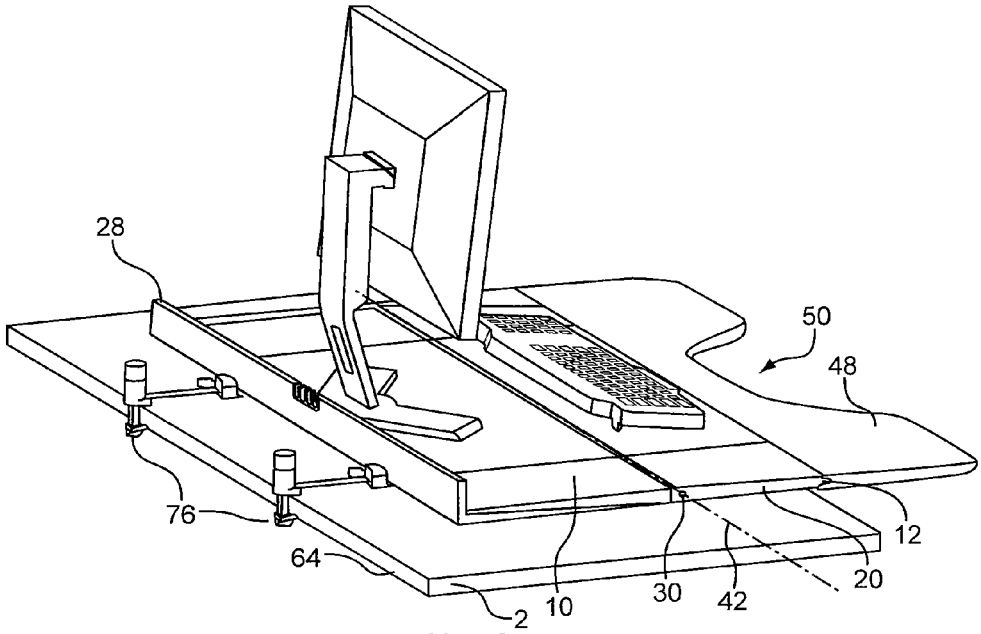
FIG. 9 is a perspective view of a second embodiment of a workstation releasably secured to a primary worksurface.
Figure 10:
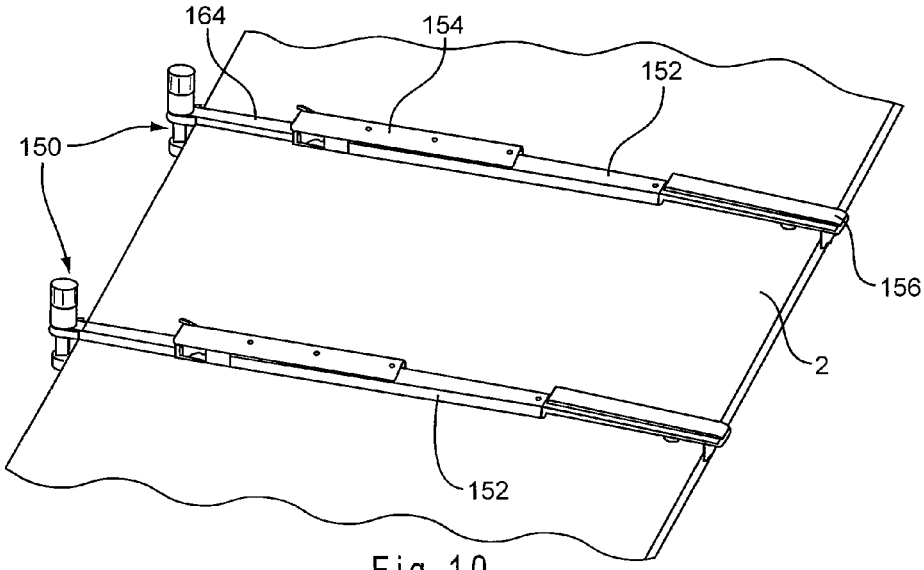
FIG. 10 is a perspective view of a base of the second embodiment of the workstation shown in FIG. 9 as secured to a primary worksurface.
Figure 11:
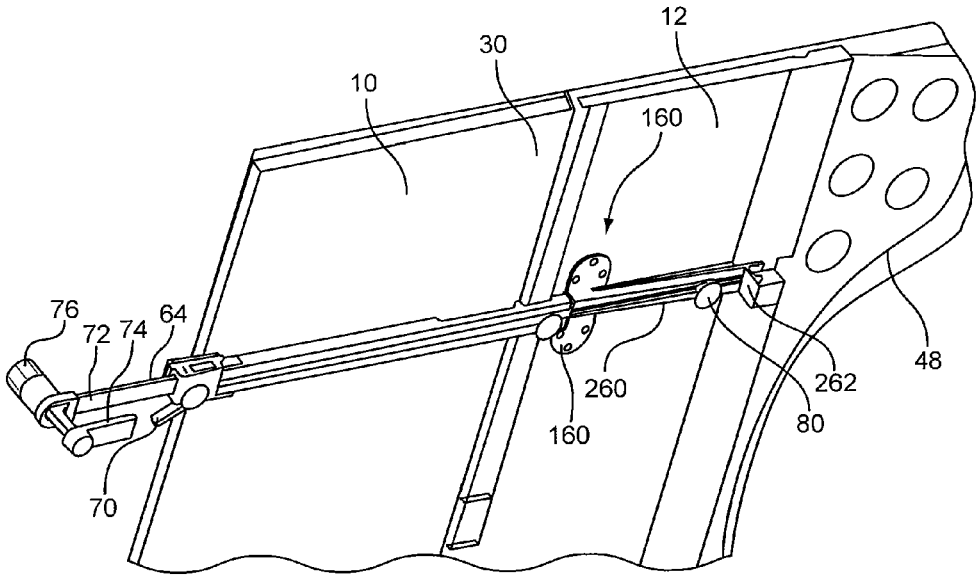
FIG. 11 is a bottom perspective view of the workstation shown in FIG. 9.

As shown in the embodiment of FIGS. 9-11, the base 150 includes a pair of spaced apart slide support bars 152, made for example of aluminum. A slide 154, including in one embodiment a ball-bearing slide interface, is positioned on a rear portion of each support bar, which defines a rear track and guide. A second molded track 156 is secured to a forward portion of the support bar, with the molded track having a downwardly sloping trajectory. One or more suction cups, or worksurface interface members 80, are secured to the bottom of the support bars 152 and are adapted to engage the top of the primary worksurface 2. The suction cups prevent movement of the workstation relative to the primary worksurface in response, for example, to a shear load in any direction. Other interface members include without limitation felt components, padding, non-slip materials, etc. Of course, the bottom of the base can directly interface with the primary worksurface and define the interface member. The worksurface interface members define, in the aggregate, a planar bottom mounting surface, which is copalanar and/or parallel with the upper surface of the primary worksurface. The first and second tracks 152, 156 and first and second guides 154, 160 are positioned entirely above the planar bottom mounting surface.

The monitor support 10 is fixedly secured to a top portion of the slide interface, or guide member 154. The auxiliary worksurface 12 has a pair of guide members 160 fixedly secured to a bottom thereof adjacent each front track member 156. The guide members are spaced apart and engage opposite sides of the track member 156 so as to move ably mount the auxiliary worksurface 12 to the base 150.

Referring to FIGS. 12-19, a base 250 includes a single rear track 252 having a support bar 254 and a slide 256 secured to a top thereof. A pair of laterally extending supports 258 are mounted to a front of the bar. A pair of front tracks 260 are mounted to the supports on opposite sides of the support bar. The front tracks include a stop or clamp portion 262 and have a downwardly sloping trajectory. In the embodiment of FIGS. 15-19, an adjustment mechanism, shown as a lead screw with a grippable actuator, is situated adjacent the front edge of the desk and can be adjusted to secure the workstation. A pair of tracks 270 can be positioned on opposite sides of the centrally located support bar to further support the monitor support. In addition, or alternatively, one or more wheels 290 are mounted to the monitor support and engage the upper surface of the primary worksurface.

Figure 17:
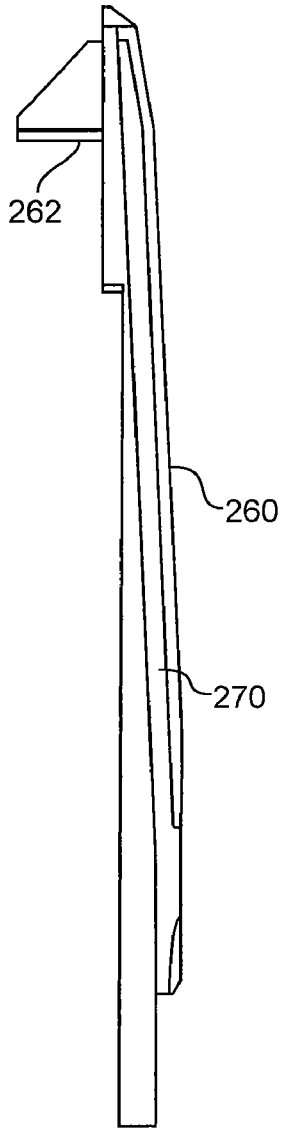
FIG. 17 is an enlarged side view of a track member.
Figure 18:
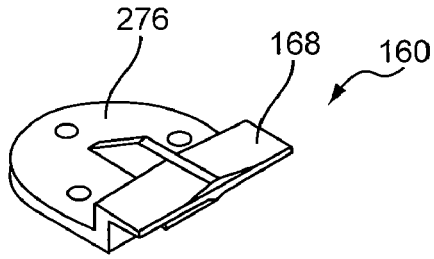
FIG. 18 is perspective view of a guide member.
Figure 19:
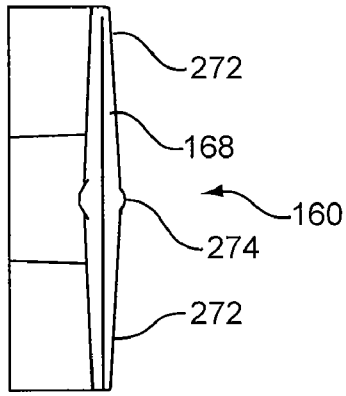
FIG. 19 is a side view of the guide member shown in FIG. 18.
Figure 20A:
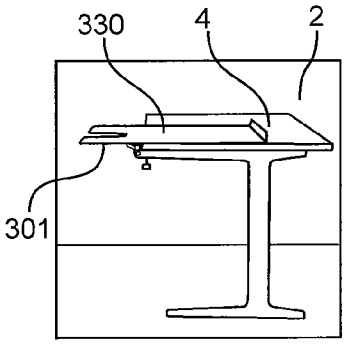
FIGS. 20A-C show views of a fourth embodiment of a workstation in a retracted, intermediate and extended position respectively.

As shown in FIGS. 17-19, the guide member includes a base portion 276 mounted to a bottom surface of the auxiliary worksurface, for example with mechanical fasteners, adhesive, or like fasteners, or combinations thereof. The guide members can also be integrally formed with the auxiliary worksurface. The guide members include a guide portion 168 having a front and rear tapered contour 272, with a central rib 274, with the guide portion 168 received in and slideably engaging a groove 270 formed in the track member 260. The rib 274 acts as a pivot pin, with the tapered contour allowing the guide to pivot relative to the track as it is moved relative thereto.

Referring to the embodiment of FIGS. 20A-29, a workstation 301 includes a base 300 having a pair of clamp members 302 joined with a laterally extending cross-brace 304. Each clamp member 302 defines a recess 306 with a support 308 shaped to receive a leading, front edge of a primary worksurface 2. A pair of clamping members 310 is rotatably supported on a pair of threaded actuators 312, which threadably engage and extend through a bottom lug 314 of the clamp members 302. A grippable member 316, configured as a knob, can be grasped and rotated so as to clamp the primary worksurface 2 between the clamping member 310 and the support 308. Of course, it should be understood that other clamping members, including various cam members, ratchet members, etc., can be used to engage the primary worksurface. In addition, the base can be configured to clamp a rear edge of the primary worksurface, the side edges of the primary worksurface, or various combinations thereof. The cross-brace 304 has opposite end portions 320 connected to the clamp members 302 and a raised intermediate portion 318 having an axis 322 vertically offset above an axis 324 of the end portions 320 adjacent an underside of a worksurface 330 so as to provide additional clearance for the legs of a user.

Figure 29:
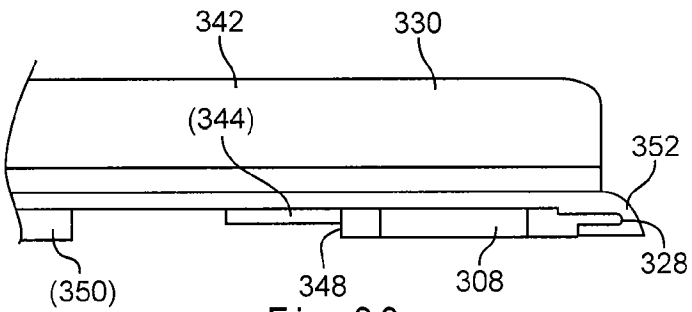
FIG. 29 is a cross-sectional view of the workstation taken along line 29-29 of FIG. 23.

The base support 308 extends rearwardly from each of the clamping members 302. A side 328 of the support defines an elongated guide member, configured as a rail, as shown in FIG. 29. Of course, it should be understood that the side may alternatively be configured as a track, for example as an elongated groove or slot. Preferably, the base 300, including the clamp members 302, cross-brace 304 and supports 308 are made of metal.

The worksurface 330 preferably is configured as a one-piece, homogenous component having a front portion 332, defining an auxiliary worksurface, and a rear portion 334, defining a monitor support. Of course, it should be understood that the rear portion 334 also provides a worksurface area. It should also be understood that the front and rear portions can be made separate, and are thereafter joined, for example by a pivot member. Preferably, in a retracted position, the front and rear portions are co-planar, and further define an upper surface substantially parallel to the primary worksurface. The overall height of the worksurface, defined between the upper surface thereof and the upper surface of the primary worksurface, is preferably between about 0.25 inches and about 1.50 inches, and in one embodiment is about 0.375 inches and no more than 1.00 inch.

The front portion 332 has a leading edge 336 forming a recess 338 shaped and positioned to receive a user's body, with side portions 340 providing support for the user's arms. The worksurface 330 is preferably made of a relatively stiff, but bendable material, including for example and without limitation a semi-rigid polymer, such as polypropylene, nylon, polycarbonate, etc., or combinations thereof. A backsplash 342 is formed along a trailing, rear edge of the worksurface. The backsplash may be configured with various features as described above. Of course, the backsplash may be omitted. In various exemplary embodiments, the width of the worksurface may is between about 28 and 42 inches, and may be about 36 inches, and the length of the worksurface, defined between the forwardmost leading edge of the front portion and the rear edge of the rear portion, is less than about 36 inches in one embodiment, less than about 24 inches in another embodiment, and may be between about 30 to 32 inches in another embodiment.

Figure 23:
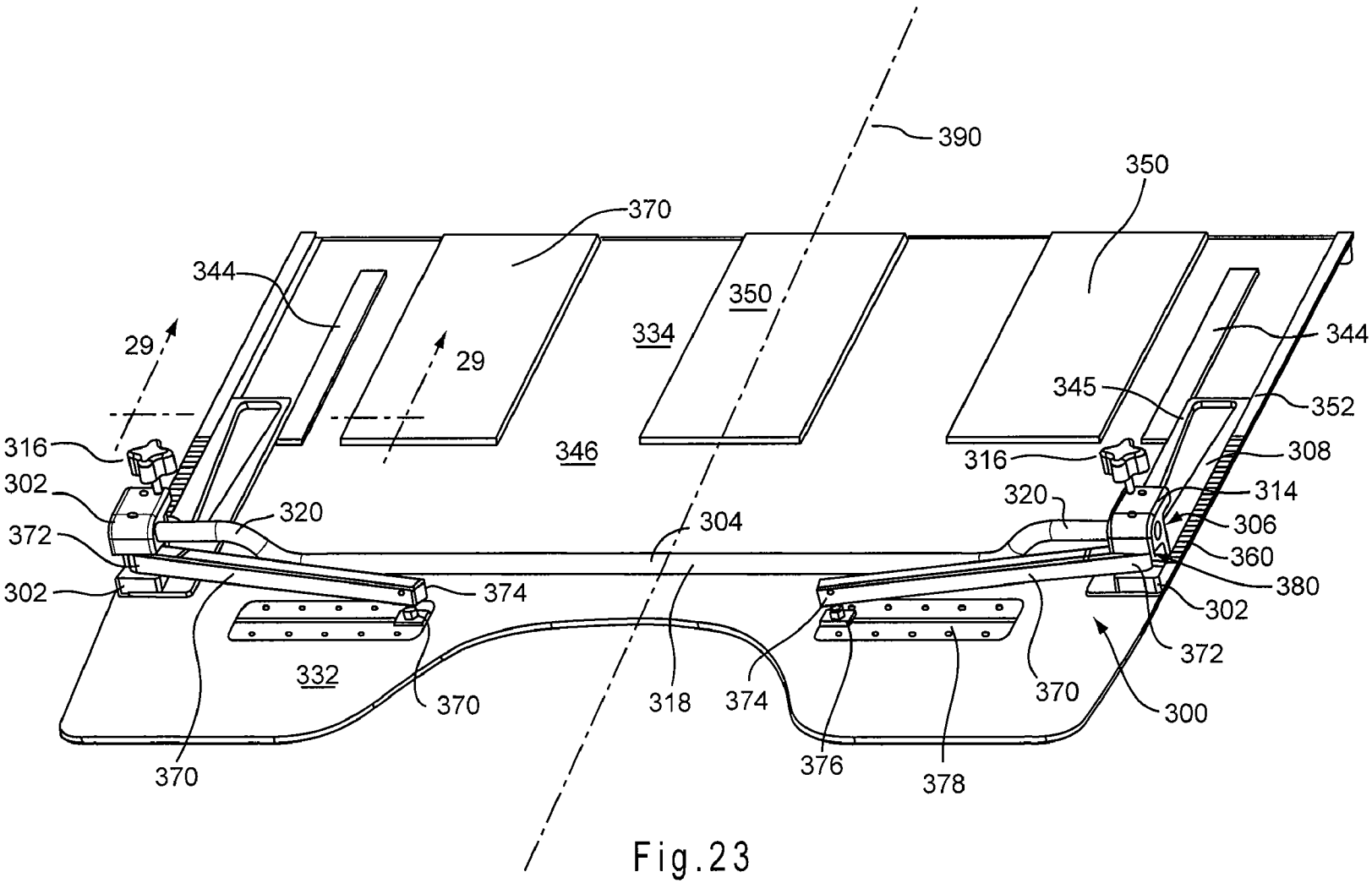
FIG. 23 is a bottom perspective view of the workstation shown in FIG. 22.
Figure 24:
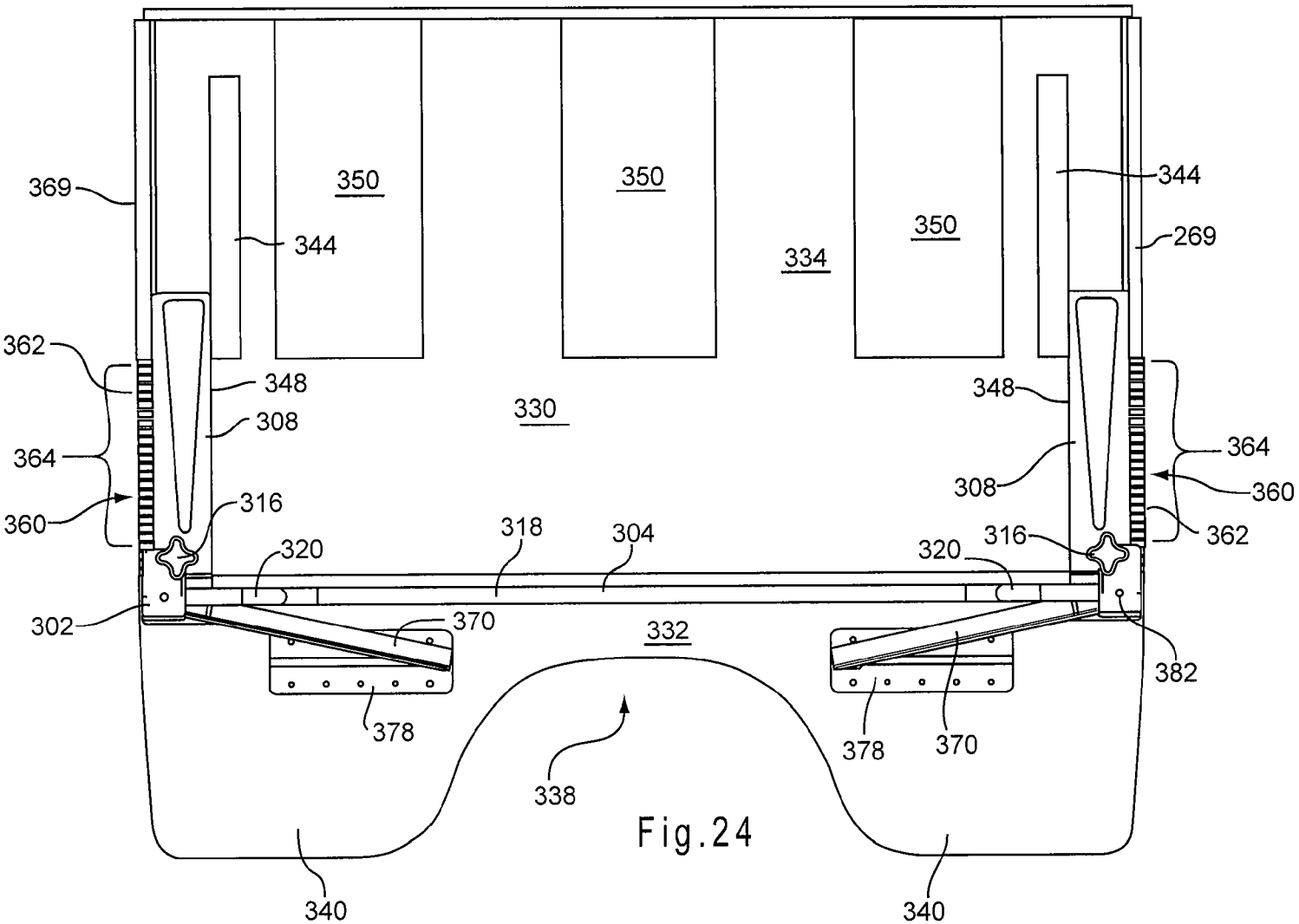
FIG. 24 is a bottom plan view of the workstation shown in FIG. 22.
Figure 25:
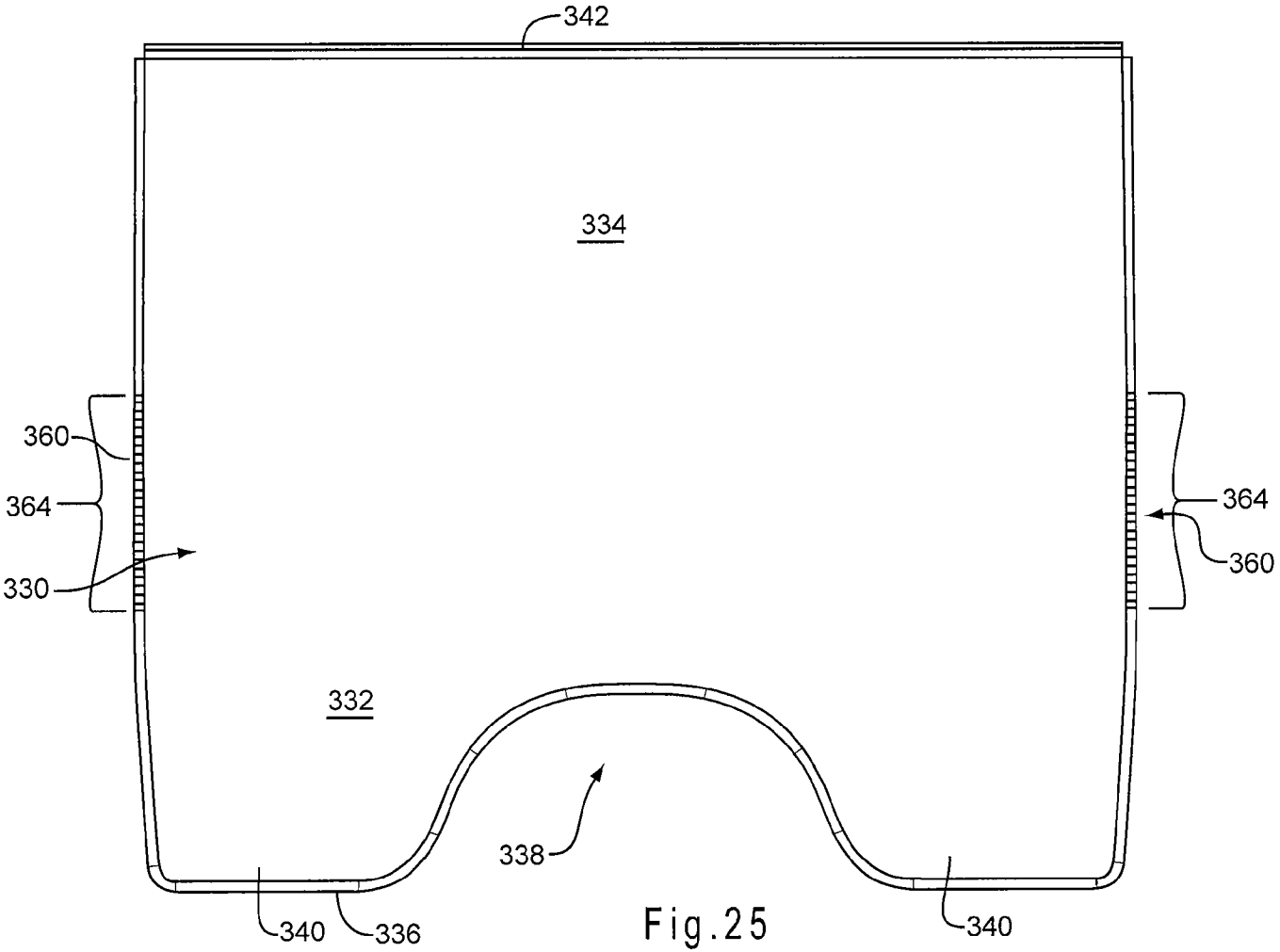
FIG. 25 is a top plan view of the workstation shown in FIG. 22.
Figure 26:
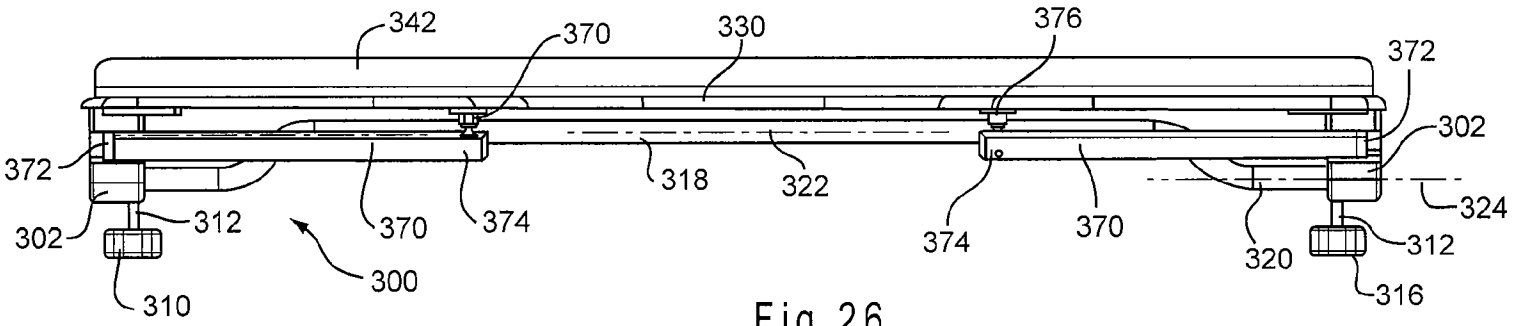
FIG. 26 is a front view of the workstation shown in FIG. 22.
Figure 27:
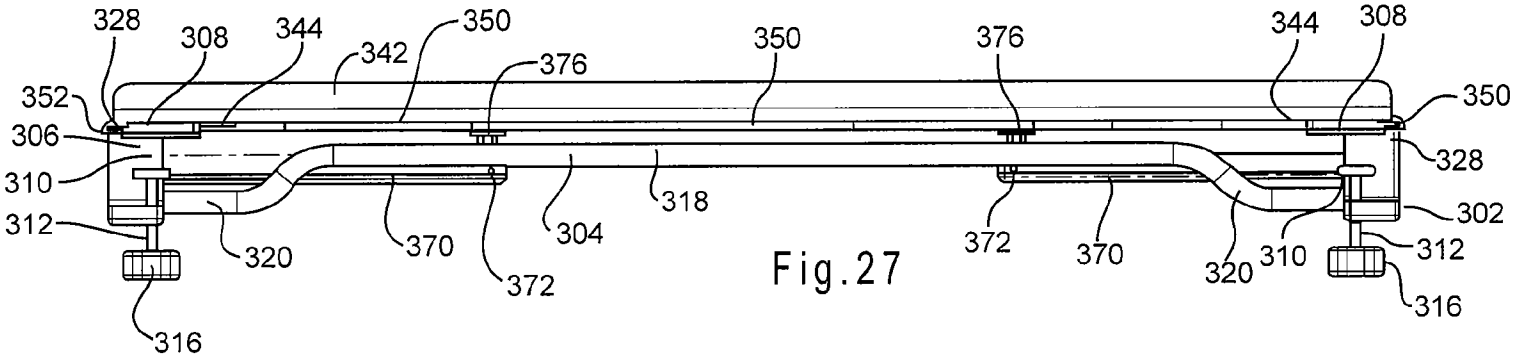
FIG. 27 is a rear view of the workstation shown in FIG. 22.
Figure 28:
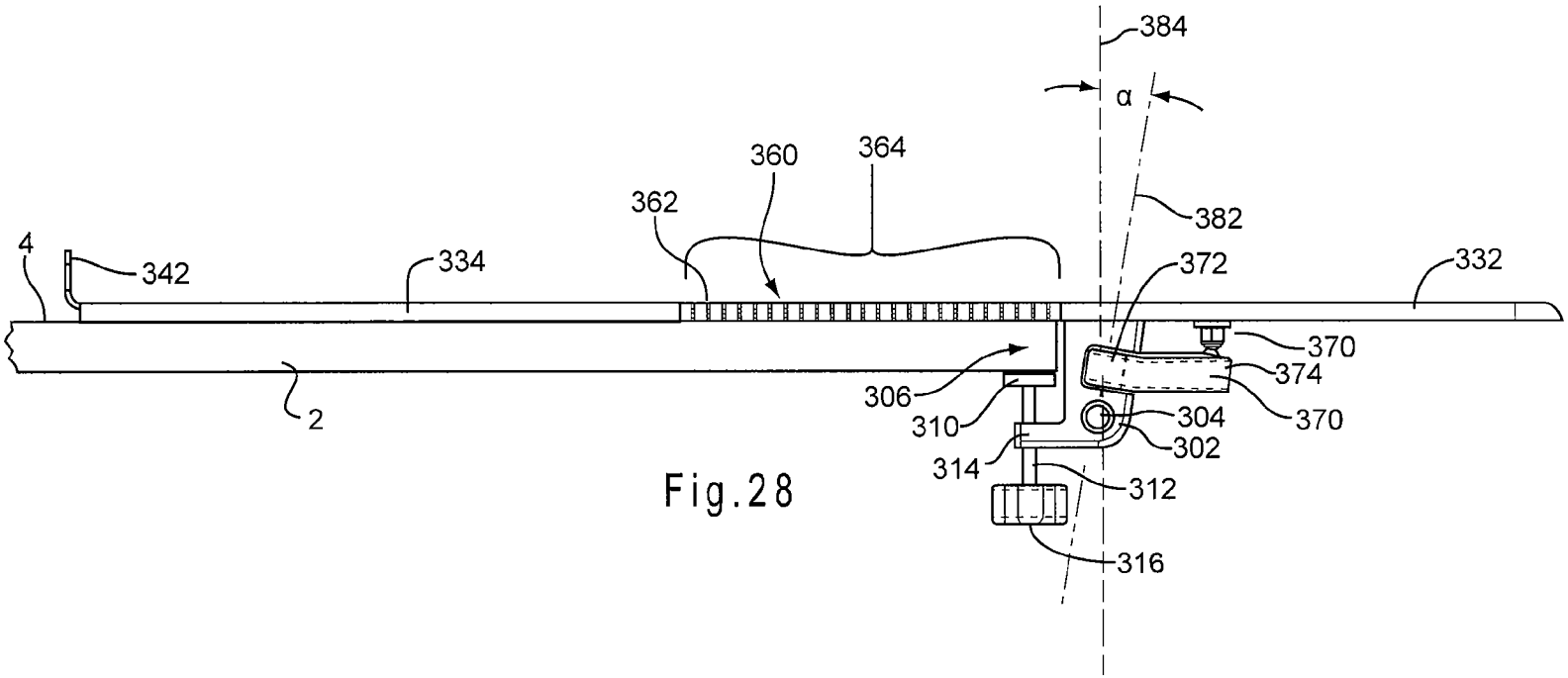
FIG. 28 is a side view of the workstation shown in FIG. 22 as applied to a primary worksurface.

Referring to FIG. 23, a pair of anti-racking rails 344 are positioned and secured to an underside 346 of the worksurface, and slide along an inner side 348 of the support 308. In addition, a plurality of slide members 350, shown as three, are laterally spaced along and coupled to the underside 346 of the worksurface. The slide members 350 are preferably formed as foam battens. The slide members 350 support the worksurface 330 on, and facilitate the sliding of the worksurface, and in particular the rear portion, along the primary worksurface 2 while preventing scuffing or other damage to the top of the primary worksurface.

Figure 21A:
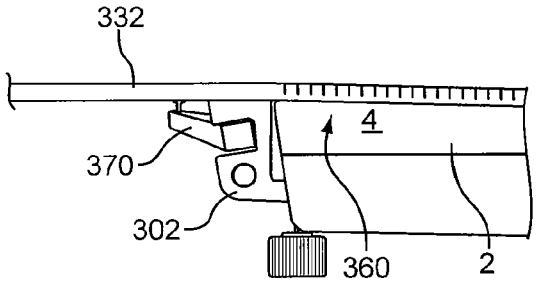
FIGS. 21A-C show enlarged partial views of the workstation shown in FIGS. 20A-C respectively.
Figure 20B:
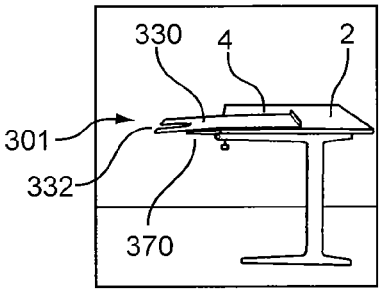
Figure 21B:
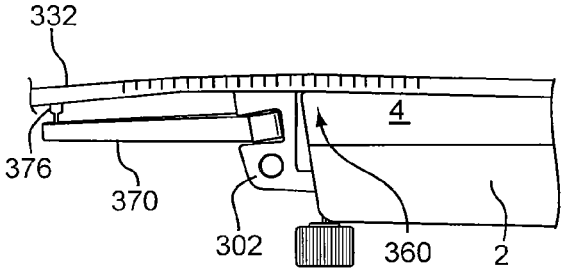
Figure 20C:
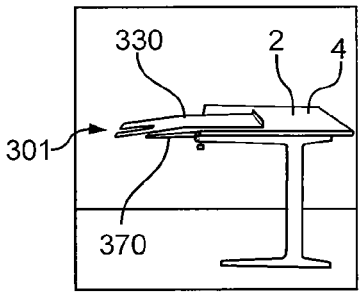
Figure 21C:
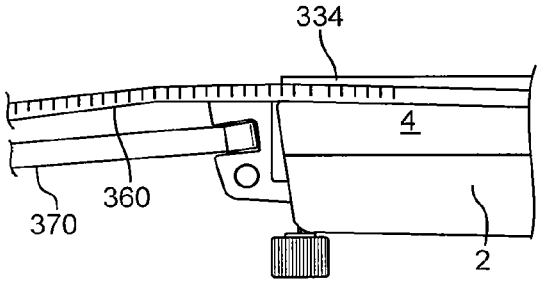
Figure 22:
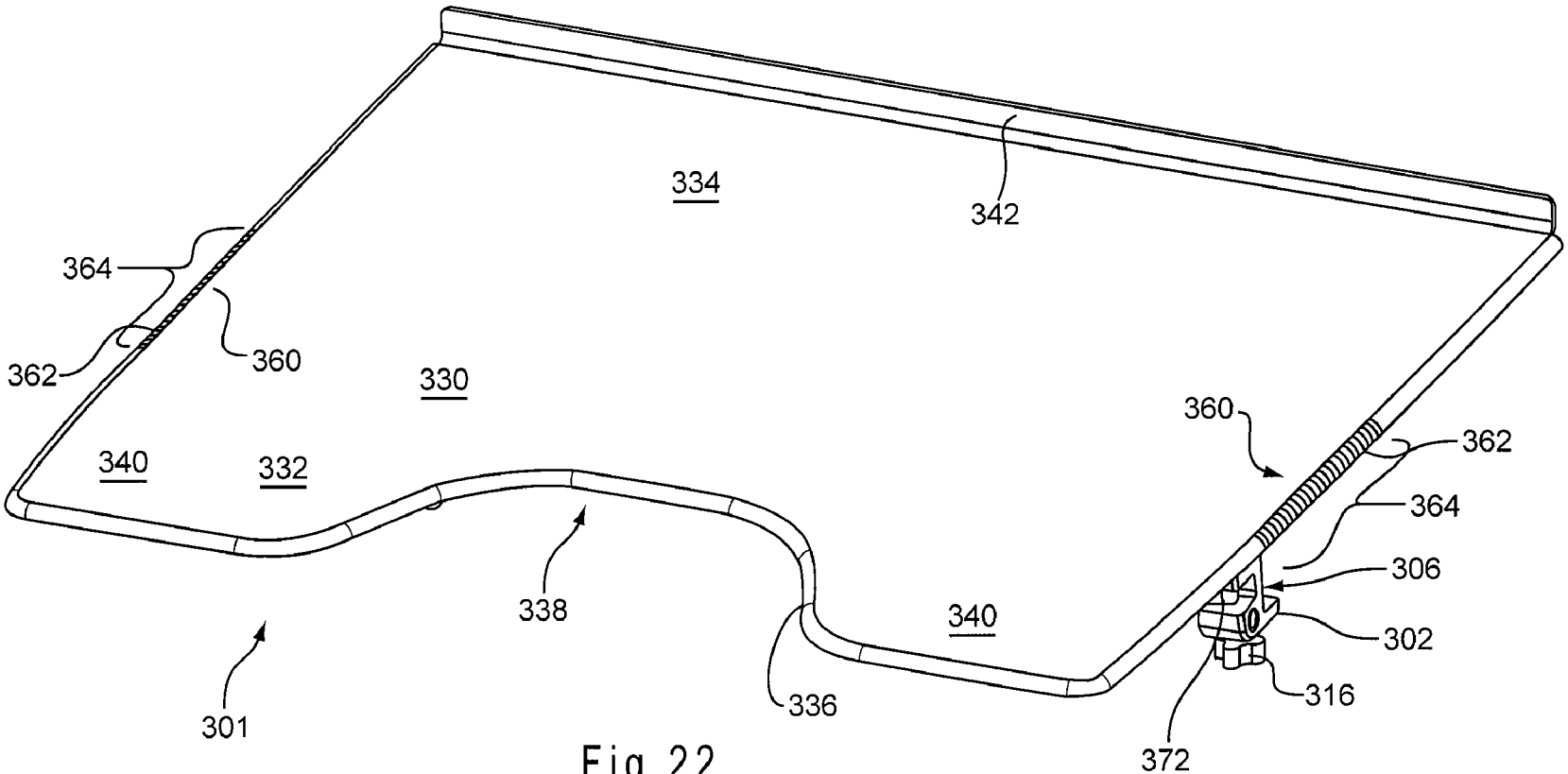
FIG. 22 is a top perspective view of the workstation shown in FIGS. 20A-C.

The worksurface 330, and in particular at least the rear portion 334 therof, further includes an elongated track 352 formed along each of the opposite sides thereof. The track 352 is shaped to receive the guide/rail 328 of the base support 308, such that the worksurface 330 slides along the rail 328 between various positions, including at least a retracted position, an intermediate position and an extended position as shown in FIGS. 21A-C. The worksurface 330 preferably is infinitely adjustable, with friction between the track 352 and guide/rail 328 maintaining the worksurface in a desired position. It should be understood that other locking mechanisms, including various detents, clamps, etc., can be used to secure the worksurface in a desired position relative to the base and/or primary worksurface.

Referring to FIGS. 21A-C, 22-25 and 28, a pair of living hinges 360 are provided along opposite sides of the worksurface 330 The living hinges 360 define a transition 364 between the front and rear portions 332, 334 of the worksurface. The living hinges 360may be formed by providing a plurality of slots 362 in the edge portion of the worksurface, such that it can more easily bend. The remainder of the edge portion is configured as a stiffening bead 369 and forms the track 352, at least along the rear portion of the worksurface.

Referring to FIGS. 21A-C, 23, 24, and 28, a pair of link members 370 are pivotally coupled to the clamp members 302. Each link member 370 has a first end 372 received in a recess 380 formed in the clamp member and pivotally coupled thereto along a pivot axis 382. The pivot axis 382 is non-vertical, and preferably forms an angle $\alpha$ of between about 5 and 10 degrees relative to a vertical plane 384. In this way, a second end 374 of each link member moves downwardly as the link members 370 pivot about the pivot axes 382.

The second end 374 of the link member is configured with a guide member 376, coupled thereto for example with a universal coupling, such that the link member can pivot relative to the guide member. Each guide member 376 engages and slides or rolls along a track 378 secured to the underside of the worksurface, and in particular the front portion 332 thereof. The tracks 378 are positioned and elongated in a lateral direction, although they may be oriented in other directions. It should be understood that the tracks may be linear, or curvilinear, such as with an arcuate shape. It also should be understood that the track may alternatively be formed on the end of the link member, with the guide extending from the underside of the worksurface.

In operation, after the workstation is secured to the primary worksurface 2 as explained above, the monitor support 10, or rear region of the worksurface, can be moved between a first position and a second position, preferably within a plane, defined for example by the primary worksurface. The auxiliary worksurface 12, or the front portion of the worksurface, which is pivotally connected to the monitor support, or rear portion of the worksurface, about the horizontal axis 42, is automatically moveable with the monitor support from a first worksurface position to a second worksurface position. In particular, as the auxiliary worksurface 12 moves along the downwardly sloping track member 58, 260, the auxiliary worksurface 12 pivots about the horizontal axis 42 as the auxiliary worksurface 10 is moved from the first worksurface position to the second worksurface position, as shown for example in FIGS. 2-6. As the auxiliary worksurface pivots about the axis 42, the downwardly facing recess 46, and concave recess 20 formed in the side walls, beneath the auxiliary worksurface receives a front edge portion 62 of the primary worksurface, allowing the auxiliary worksurface to pivot without interfering with the primary worksurface. At the same time, the monitor support 10 is moved within a horizontal plane, or other plane parallel to and defined by the primary worksurface. For example, in one embodiment, the monitor support and auxiliary worksurface will travel between about 1 and 10 inches, and in one embodiment about 7 inches. In addition, the auxiliary worksurface will pivot to about a 7 degree angle relative to the original reference plane, defined by the monitor support and/or primary worksurface.

Referring to the embodiment of FIGS. 20A-29, the auxiliary worksurface, or the front portion 332 of the worksurface, bends relative to the monitor support, or rear portion 334 of the worksurface, about a horizontal axis or axes and is automatically moveable with the rear portion 334 from a first worksurface position to a second worksurface position. The rear portion 334, with the slide members 350, slides on top of the primary worksurface 2 as the guides 352 formed in the sides thereof are moved along the elongated guide/rail 328 of the base. It should be understood that the position of the horizontal pivot axis may vary as the worksurface bends, and may also be virtual, or constitute a plurality of pivot axes. As the rear portion 334 is translated along the rail 328, preferably within a plane, the front portion 332 is automatically pushed forwardly. Simultaneously, the link members 370, and in particular the second ends 374 thereof, pivot and translate outwardly relative to a longitudinally extending centerline 390 of the front portion, while the first ends 372 pivot relative to the base, and in particular the clamp member 302. Since the pivot axes 382 of the link members 370 are non-vertical, and preferably form an angle a, relative to a laterally extending vertical plane 384, the link members 370 pull the front portion 332 downwardly, thereby bending the worksurface 330 about a horizontal pivot axis or axes. In the reverse direction, the link members 370 push the front portion 332 upwardly to a substantially planar configuration relative to the rear portion. It should be understood that a single link member can be used to impart the pivoting/bending of the worksurface.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A workstation comprising:

a base adapted to be supported on a primary worksurface, said base comprising a releasable attachment mechanism adapted to releasably secure said base to the primary worksurface;

a worksurface comprising a rear portion and a front portion, said worksurface moveable in a longitudinal direction between a first position and a second position, wherein said front portion is automatically downwardly pivotable relative to said rear portion as said worksurface is moved between said first and second positions; and at least one link member having a first end pivotally connected to said base about a pivot axis and a second end pivotally and translatably connected to said front portion, wherein said first and second ends are laterally spaced along a lateral direction extending transverse to said longitudinal direction.

2. The workstation of claim 1 wherein said pivot axis is non-vertical.

3. The workstation of claim 1 wherein a transition between said front and rear portions is defined by a pair of living hinge formed along opposite sides thereof.

4. The workstation of claim 1 further comprising a guide formed on one of said second end of said link member and said front portion, and a track defined on the other of said second end of said link member and said front portion, wherein said guide is translatable along said track as said worksurface is moved between said first and second positions.

5. The workstation of claim 1 wherein one of said base and said rear portion comprises a guide and the other of said base and said rear portion comprises a track, wherein said guide is moveable along said track as said worksurface is moved between said first and second positions.

6. The workstation of claim 1 wherein said front and rear portions are formed as a single, homogenous sheet, wherein said front portion is bendable relative to said rear portion as said worksurface is moved between said first and second positions.

7. The workstation of claim 1 wherein said releasable attachment mechanism comprises a clamp adapted to releasably engage the primary worksurface.

8. A workstation comprising:

a base adapted to be supported on a primary worksurface, said base comprising a releasable attachment mechanism adapted to releasably secure said base to the primary worksurface;

a worksurface comprising a rear portion and a front portion, said worksurface moveable between a first position and a second position, wherein said front portion is automatically downwardly pivotable relative to said rear portion as said worksurface is moved between said first and second positions; and at least one link member having a first end pivotally connected to said base about a pivot axis and a second end pivotally and translatably connected to said front portion, wherein said pivot axis is non-vertical, and wherein said pivot axis forms an angle of between about 5 degrees and 15 degrees relative to a vertical axis.

* * * * *